US007204093B2

(12) United States Patent
Kwon et al.

(10) Patent No.: US 7,204,093 B2
(45) Date of Patent: Apr. 17, 2007

(54) CENTRAL CONTROL SYSTEM OF AIR CONDITIONERS AND METHOD FOR OPERATING THE SAME

(75) Inventors: Jae Hwan Kwon, Seoul (KR); Sang Chul Youn, Kyungki-do (KR); Duck Gu Jeon, Seoul (KR); Jae Sik Jung, Seoul (KR); Young Soo Yoon, Seoul (KR); Jun Tae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 358 days.

(21) Appl. No.: 10/847,297

(22) Filed: May 18, 2004

(65) Prior Publication Data

US 2005/0097905 A1 May 12, 2005

(30) Foreign Application Priority Data

Jun. 11, 2003 (KR) ..... 10-2003-0037410

(51) Int. Cl.
*G05D 23/32* (2006.01)
*G05D 23/00* (2006.01)

(52) U.S. Cl. ..... 62/157; 236/1 B; 236/51

(58) Field of Classification Search ..... 62/157, 62/126; 236/1 B, 51
See application file for complete search history.

(56) References Cited

U.S. PATENT DOCUMENTS

2004/0107717 A1 6/2004 Yoon et al.

FOREIGN PATENT DOCUMENTS

| | | | |
|---|---|---|---|
| JP | 11118228 A | * | 4/1999 |
| JP | 2000-121126 | | 4/2000 |
| JP | 2000186844 A | * | 7/2000 |
| JP | 2002-010532 | | 1/2002 |
| JP | 2002010532 A | * | 1/2002 |

OTHER PUBLICATIONS

English language Abstract of JP 2000-121126.
English Language Abstract of JP 2002-010532.

* cited by examiner

*Primary Examiner*—Chen Wen Jiang
(74) *Attorney, Agent, or Firm*—Greenblum & Bernstein, P.L.C.

(57) ABSTRACT

A central control system includes a plurality of air conditioners and a central control unit connected to the air conditioners over a network. The air conditioners are installed in rooms of a building to provide air conditioning in the rooms. The central control unit receives a control command for monitoring and controlling each of the air conditioners, and adjusts an operating schedule of each of the air conditioners to limit total peak power consumption of the air conditioners in operation below a reference power value. The central control unit controls the operation of each of the air conditioners based on the adjusted operating schedule. When the total peak power consumption exceeds the reference power value, the central control unit prevents the entire air conditioning system from shutting down, which improves stability of the air conditioning system and decreases electricity costs for air conditioning.

19 Claims, 5 Drawing Sheets

CENTRAL CONTROL SYSTEM OF AIR CONDITIONERS AND METHOD FOR OPERATING THE SAME

BACKGROUND OF THE INVENTION

1. Field of the Invention

The present invention relates to a central control system of air conditioners and a method for operating the same, wherein a central control unit is connected to a plurality of air conditioners via a network to perform central control of the operations of the air conditioners, and an automatic operating algorithm is implemented in the central control unit for changing the operating mode of each of the air conditioners to limit the total peak power consumption of running air conditioners below a reference power value, which makes it possible to decrease the total peak power consumption of the building and the electricity costs, and also to prevent forcible power cut-off due to a rapid increase in power consumption.

2. Description of the Related Art

As use of air conditioners rapidly increases, air conditioners can now be found in each room of a residence or in each office of a building. An air conditioning system connected to a plurality of air conditioners via a network has also been provided recently.

One example of the air conditioning system is a single-type air conditioning system in which indoor units 11 are connected respectively with outdoor units 12 as shown in FIG. 1. Another example is a multi-type air conditioning system in which a larger number of indoor units 11 share a smaller number of outdoor units 12 provided in a single building or on a single floor, as shown in FIG. 2, to save installation resources and energy.

To provide cooling, the air conditioner 10 generally uses refrigerant that circulates in the indoor and outdoor units in a thermal cycle of compression, condensation, expansion and evaporation. On the other hand, a heat-pump air conditioner can provide cooling and heating by switching circulation directions of the refrigerant.

In the conventional air conditioning system, a control button mounted on the indoor unit or a remote controller allows a user to input a control command for power on/off, cooling/heating mode selection, blowing mode selection, control of the direction of discharged air, control of cooling/heating or blowing intensity, etc. Based on the input control command, a microcomputer embedded in the indoor unit controls the amount of refrigerant and the flow of refrigerant to perform indoor air conditioning.

If an error occurs in the operation of an air conditioner, a manager of the building personally goes to an indoor unit 11 or an outdoor unit 12 of the air conditioner to check the error, and then inputs a control command for maintenance and repair of the air conditioner.

In the case where one manager manages a plurality of air conditioners as in a school or a large building, the manager visits each room to input a control command and perform a manual maintenance and repair process of the air conditioner.

Some conventional air conditioning systems can perform central control of a plurality of air conditioners via a central control unit 20 that is connected to the plurality of air conditioners over a network via power lines or the like. However, such conventional air conditioning systems are provided with only a power lamp for checking the power state of each air conditioner and a power button for controlling the power of each air conditioner. The conventional systems cannot input a control command for controlling detailed operations of the air conditioner, and thus the central control unit 20 cannot be used for maintenance and repair when an error occurs in the operation of the air conditioner, which lowers the usability of the systems.

In particular, the air conditioner 10 has high power consumption for initial operation. In the case where a number of air conditioners are installed as in a large building, the total peak power consumption of the air conditioners is considerable in the normal operation also, raising a concern that the total peak power consumption exceeds the allowable limit of a power breaker (not shown) installed in the building.

If the total peak power consumption exceeds the allowable limit of the power breaker, the power breaker forces the entire power of the building to be cut off. The forcible power cutoff may cause a physical impact not only on a running air conditioner but also on other electric devices, thereby lowering endurance of the product.

An electricity supplier provides different upper power limits depending on seasons/buildings/service providers. If the total peak power consumption exceeds the upper power limits, the electricity supplier charges progressive electricity rates, which increases the burden of paying the electricity bills.

SUMMARY OF THE INVENTION

Therefore, the present invention has been made in view of the above problems, and it is an object of the present invention to provide a central control system of air conditioners and a method for operating the same, wherein the system is provided with a central control unit including a database for storing power consumption values of a plurality of indoor and outdoor units installed in a building, and the central control unit changes operating modes of the air conditioners to limit the total peak power consumption of the air conditioners currently in operation below a reference power value, which allows central control of operations of a plurality of air conditioners and also achieves stable central management of power consumptions of the air conditioners.

In accordance with one aspect of the present invention, the above and other objects can be accomplished by the provision of a central control system of air conditioners, comprising a plurality of air conditioners, installed in rooms of a building, for providing air conditioning; and a central control unit, connected to the plurality of air conditioners via a network, for receiving a control command for monitoring and controlling each of the air conditioners, said central control unit adjusting an operating schedule of each of the air conditioners for limiting a total peak power consumption of the plurality of air conditioners in operation below a reference power value, said central control unit controlling an operation of each of the air conditioners based on the adjusted operating schedule.

In accordance with another aspect of the present invention, there is provided a method for operating a central control system of air conditioners, said central control system including a central control unit connected to a plurality of air conditioners via a network, said central control unit being capable of monitoring states of the air conditioners and of controlling operations of the air conditioners, said method comprising the steps of a) comparing a total peak power consumption of a plurality of air conditioners currently in operation with a previously input reference power value; b), if the compared result at said step a)

is that the total peak power consumption exceeds the reference power value, allowing at least one air conditioner selected from the plurality of air conditioners currently in operation to maintain a normal operating mode, and allowing at least one unselected air conditioner in operation, other than the selected air conditioner, to switch to a blowing mode; c), if an operating time in the operating mode switched at said step b) exceeds a previously input mode change period, updating an operating schedule of each of the air conditioners; and d) controlling operations of the air conditioners according to the updated operating schedules.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

The configuration of a central control system of air conditioners according to the present invention will now be described with reference to FIG. 3.

A plurality of air conditioners 100 are installed respectively in rooms of a building. The following description will be given with reference to a single-type air conditioning system in which each of the air conditioners 100 includes an indoor unit 110 and an outdoor unit 120. However, the type of the air conditioning system does not limit the scope and spirit of the present invention.

Figure 1:
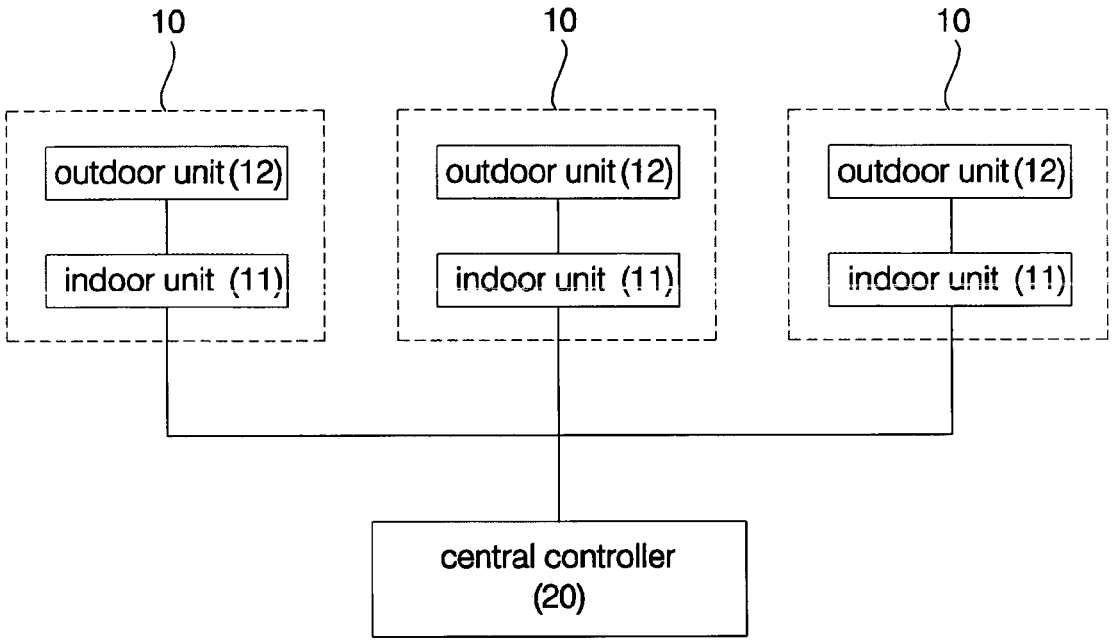
FIG. 1 (Prior Art)
FIG. 1 is a block diagram showing the configuration of a single-type air conditioning system in the prior art.
Figure 2:
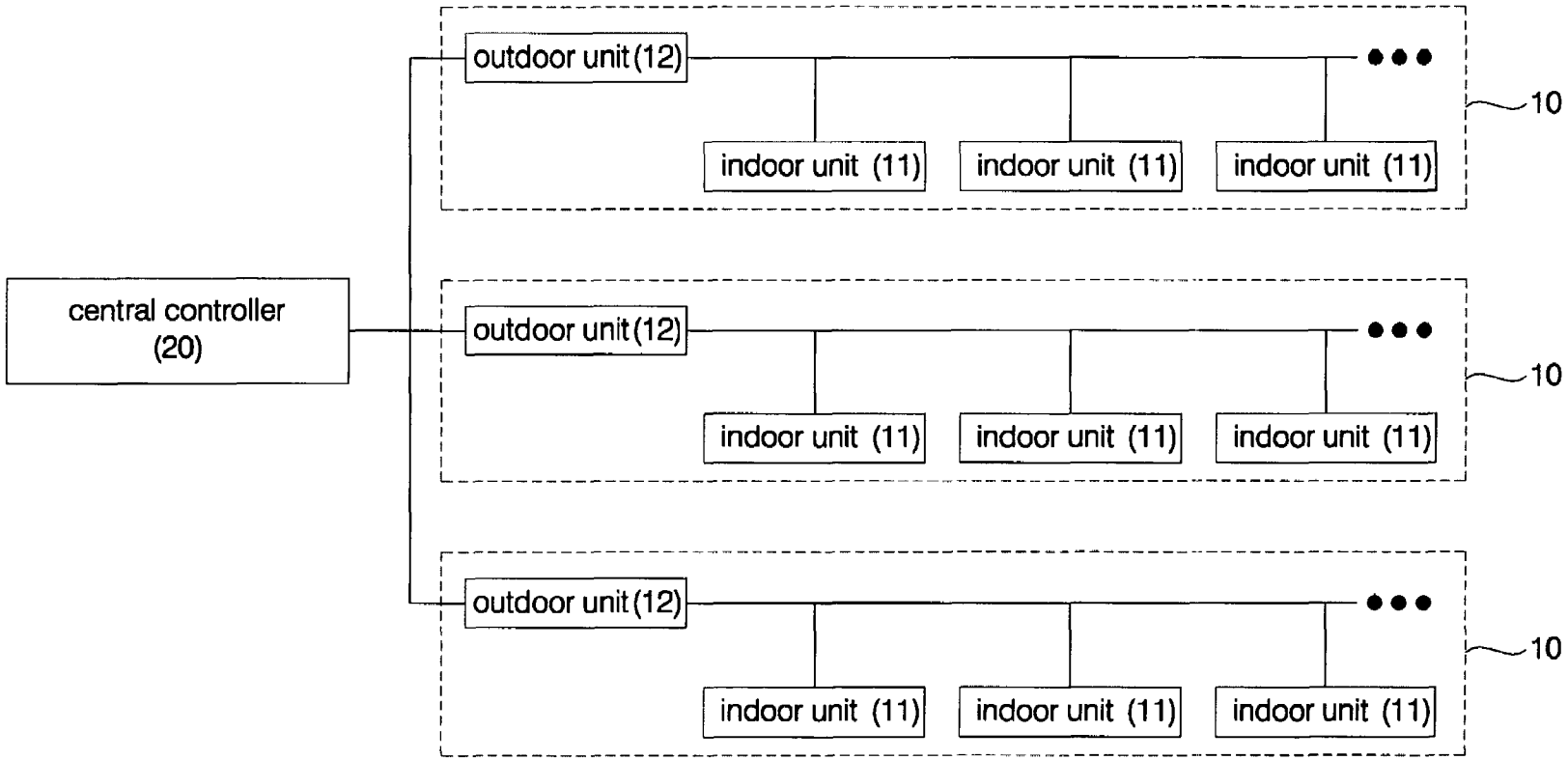
FIG. 2 (Prior Art)
FIG. 2 is a block diagram showing the configuration of a multi-type air conditioning system in the prior art.
Figure 3:
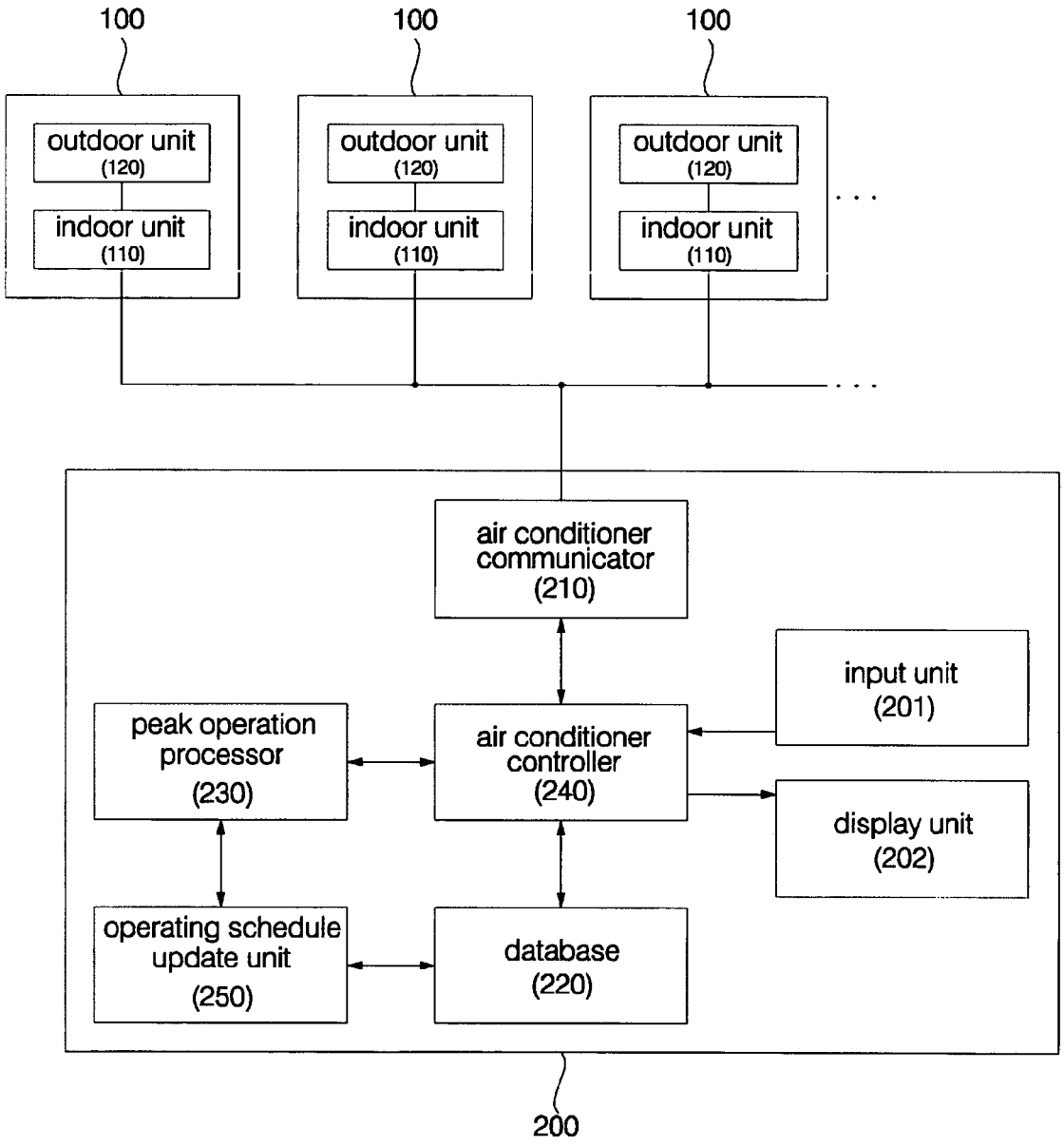
FIG. 3 is a block diagram showing the configuration of a central control system of air conditioners according to the present invention.

As shown in FIG. 3, a central control unit 200 is connected to the air conditioners 100 via a network to monitor the state information of each air conditioner 100 and transmit a control signal according to an input control command to a corresponding air conditioner. In this manner, the central control unit 200 performs central control of the operation of each air conditioner.

The central control unit 200 basically includes an input unit 201 for inputting a control command, and a display unit 202 for displaying the state information of an air conditioner operating according to the control command input through the input unit 201. According to manufacturers, the input unit 201 and the display unit 202 may be implemented as a touch screen integrated into a single unit. In this case, the control command may be input by touching the touch screen.

The central control unit 200 further includes an air conditioner communication module 210, a database 220, a peak operation processor 230, an air conditioner controller 240 and an operating schedule update unit 250.

The conditioner communication module 210 allows the central control unit 200 to transmit and receive signals to and from the plurality of air conditioners via the network established in the building. Through the air conditioner communication module 210, the central control unit 200 can transmit a control signal according to an input control command and receive the state information of air conditioners in response to the transmitted control signal.

The central control unit 200 controls the operating modes of the air conditioners 100 so as to limit the total peak power consumption of the air conditioners 100 below the upper power limit allowed in the entire building. To accomplish this, the central control unit 200 includes the database 220 for storing the maximum power consumption value of each air conditioner. The air conditioner 100 installed in each room has a different power consumption value depending on the manufacturer, and the product type and model. The manufacturer generally provides numerical information of the power consumption value, which is usually written on one side of the air conditioner.

Via the air conditioner communication module 210, the peak operation processor 230 detects air conditioners currently in operation. With reference to the maximum power consumption value of each air conditioner stored in the database 220, the peak operation processor 230 calculates the total peak power consumption of all of the air conditioners currently in operation.

The peak operation processor 230 compares the total peak power consumption of the air conditioners in operation with a predetermined reference power value less than the upper power limit. The manager of the central control unit 200 has previously input the predetermined reference power value through the input unit 201. The peak operation processor 230 determines the operating schedule and operating mode of each air conditioner so that the air conditioners operate while limiting the total peak power consumption below the reference power value.

The reference power value is numerical information that the manager may input taking into consideration the upper power limit that is provided by the electricity supplier and varies depending on the seasons/buildings/service providers. If the total peak power consumption is higher than the reference power value, the central control system enters a peak control mode to activate automatic operations of the air conditioners via the central control unit 200. If the total peak power consumption is equal to or lower than the reference power value, each air conditioner maintains its operating mode set according to a control command individually input to each air conditioner.

The air conditioner controller 240 controls the flow of signals relating to state monitoring and control of each air conditioner. The air conditioner controller 240 also issues control signals to corresponding air conditioners to allow the air conditioners to operate in their operating modes determined by the peak operation processor 230.

In other words, if the total peak power consumption of the air conditioners in operation is equal to or lower than the reference power value, no central control of the air conditioners is performed via the peak operation processor 230. However, if the total peak power consumption is higher than the reference power value, respective operation modes of the air conditioners are determined through an automatic operation algorithm of the peak operation processor 230, and the air conditioner controller 240 issues control signals for switching the operating modes (cooling mode ↔blowing mode) according to the determined operation modes.

Through the input unit 201, the manager can input the reference power value for limiting the total peak power consumption and can also input an operating mode change period at intervals of which the peak operation processor 230 changes the operating modes of the air conditioners.

The peak operation processor 230 changes the operating modes of the air conditioners at intervals of the mode change period. If the total peak power consumption is higher than the reference power value, the peak operation processor 230 allows selected air conditioners in operation to operate in a normal mode (for example, a cooling mode) and allows the remaining air conditioners (i.e., the unselected ones) in operation to operate in a blowing mode. To decrease the total peak power consumption of the air conditioners while avoiding rapid changes in the indoor temperature, the peak operation processor 230 does not completely turn off the unselected air conditioners but allows them to operate in the blowing mode in which power consumption is low.

The peak operation processor 230 changes the operating modes of the air conditioners by operating schedules that are updated at intervals of the mode change period. The operating schedule update unit 250 adjusts the operating schedules.

The operating schedule update unit 250 updates the operating schedule of each air conditioner in a FIFO (First In First Out) scheme in which an air conditioner that has entered the blowing mode first enters the normal mode for cooling or heating first.

The operating schedule update unit 250 may also update the operating schedule of each air conditioner in such a manner that air conditioners enter the normal mode in descending order of the amount of change in the corresponding indoor temperatures that are detected respectively in rooms where the air conditioners are installed. The two operating schedule update methods may be used selectively or jointly according to the manufacturers.

Figure 4:
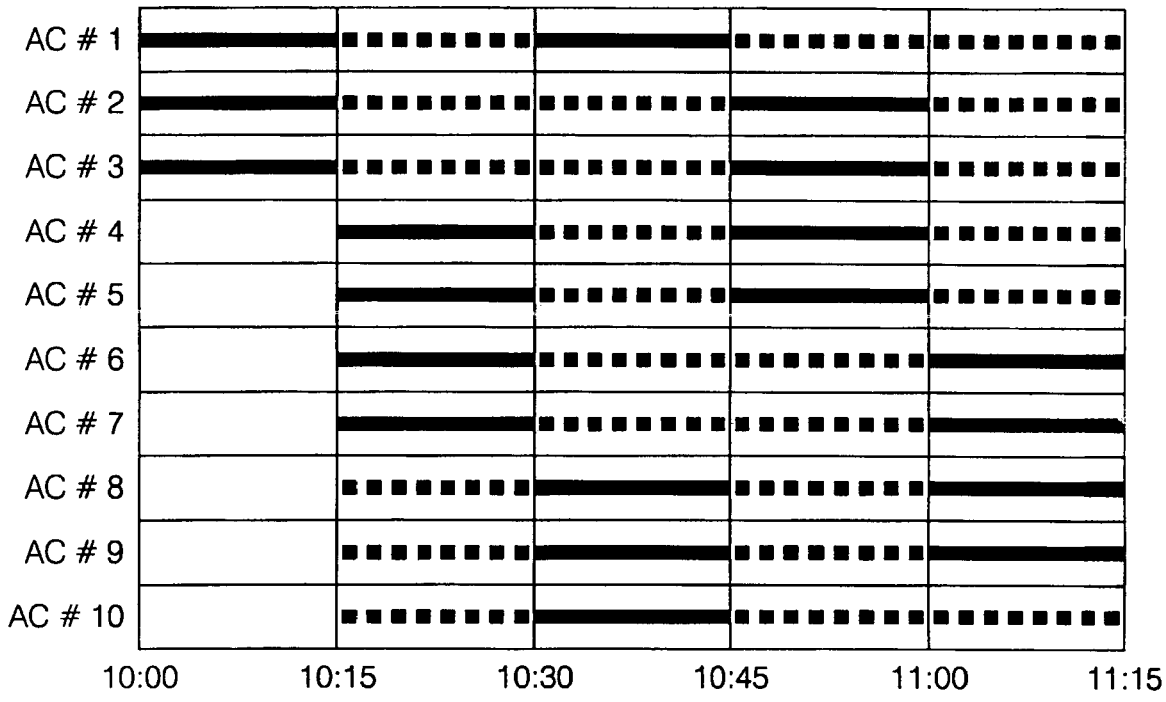
FIG. 4 is a diagram showing operating schedules of air conditioners according to the present invention.
Figure 5:
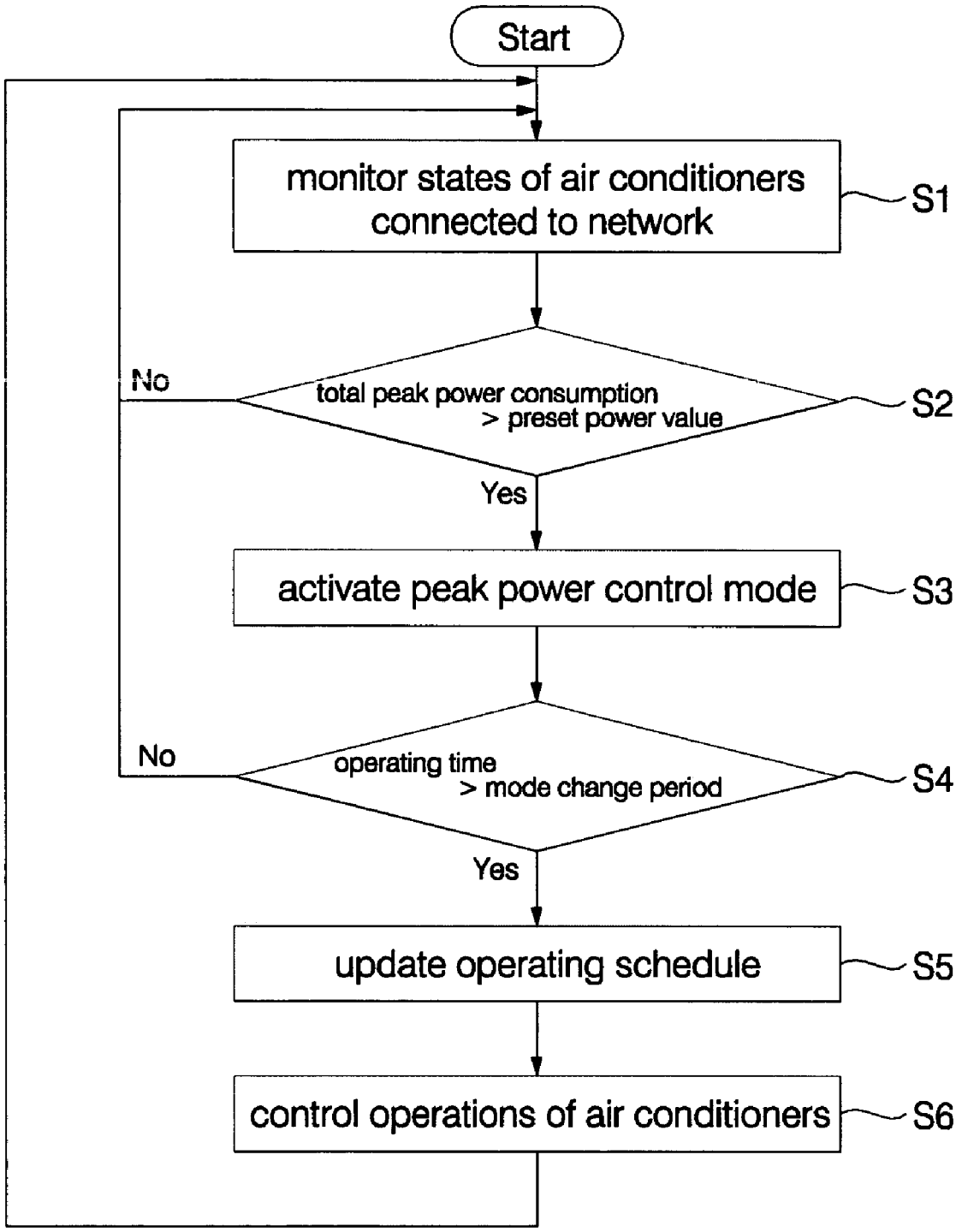
FIG. 5 is a flow chart showing a method for operating the central control system of air conditioners according to the present invention.

FIG. 4 illustrates an operating schedule table that is determined by the operating schedule update unit 250.

For better understating of the procedure for updating the operating schedule according to this embodiment, the procedure will be described under the following assumptions.

1) n air conditioners with the same maximum power consumption value P are installed respectively in n rooms, where the maximum value of the total peak power consumption of the air conditioners is (n×P)W.

2) The manager sets a reference power value to (0.4×n×P)W to allow the total peak power consumption of air conditioners in operation to be limited below the reference power value.

3) The manager sets the operating mode change period to 15 minutes.

4) 10 air conditioners are installed (i.e., n=10)

Under these assumptions, the total peak power consumption of the first to third air conditioners AC#1 to AC#3 in operation is (3×P)W between 10:00 and 10:15 as shown in the operating schedule table of FIG. 4. Since the total peak power consumption (3×P)W is lower than the reference power value (4×P)W, the first to third air conditioners AC#1 to AC#3 maintain their operating modes as set by individual control in respective rooms of the air conditioners AC#1 to AC#3 without change of the operating modes via the peak operating processor 230.

At 10:15, all of the 10 air conditioners are in operation. Thus, the peak operating processor 230 changes the operating modes of the air conditioners. Here, the operating schedule update unit 250 updates the operating schedule of each air conditioner in a FIFO scheme such that the fourth to seventh air conditioners AC#4 to AC#7 operate in the normal mode for cooling or heating and the remaining air conditioners AC#1 to AC#3 and AC#8 to AC#10 operate in the blowing mode. In FIG. 4, solid lines indicate that the corresponding air conditioners operate in the normal mode and dotted lines indicate that the corresponding air conditioners operate in the blowing mode.

At 10:30 after the mode change period (15 minutes) has passed, the operating schedule update unit 250 again updates the operating schedule of each air conditioner in the same manner as described above, so that the operation modes of the four air conditioners AC#1, AC#8, AC#9 and AC#10 are changed to the normal mode and the operation modes of the remaining air conditioners are changed to the blowing mode.

At 10:45 after the mode change period has passed, the second to fifth air conditioners AC#2, AC#3, AC#4 and AC#5 switch to the normal mode and the remaining air conditioners maintain the blowing mode. At 11:00, the sixth to ninth air conditioners AC#6, AC#7, AC#8 and AC#9 switch to the normal mode and the remaining air conditioners switch to the blowing mode.

In this manner, the operating schedule update unit 250 updates the operating schedule of each air conditioner at intervals of the mode change period. Based on the updated operating schedule, the peak operation processor 230 switches the operating modes to allow the total peak power consumption of air conditioners in operation to be limited below the reference power value (4×P)W while approximately maintaining the room temperature.

A method for operating the central control system of air conditioners configured as described above will now be described with reference to a flow chart shown in FIG. 4.

First, via the air conditioner communication module, the central control system monitors the states of air conditioners connected to the network to select air conditioners currently in operation therefrom (S1).

The central control system then calculates a total peak power consumption of the air conditioners currently in operation, and compares the calculated total peak power consumption with a reference power value previously input by a manager of the system (S2).

If the compared result is that the total peak power consumption is higher than the reference power value, the central control system performs peak power control in such a manner that selected air conditioners in operation maintain the normal mode, and the remaining air conditioners in operation switch to the blowing mode. If the total peak power value is equal to or lower than the reference power value, the central control system maintains the previous operating states. When the peak power control is being performed through the central control unit, the previous operating states of the air conditioners are maintained while blocking the operation control via the individual air conditioners in the rooms (S3).

Then, the central control system checks whether an operating time in the changed operating mode exceeds the mode change period (S4).

If the checked result is that the operating time exceeds the mode change period, the central control system updates the operating schedules of the air conditioners, and if not, the system continuously monitors the operating states of the air conditioners (S5).

Two methods may be used selectively or jointly to update the operating schedule. One method is a FIFO (First In First Out) scheme in which an air conditioner that has entered the blowing mode first enters the normal mode first. The other is to allow air conditioners to enter the normal mode for heating or cooling in descending order of the amount of change in the temperatures of rooms where the air conditioners are installed.

The central control system controls operations of the air conditioners according to the updated operating schedules, and then returns to the initial step where the central control system continuously monitors the total peak power consumption of running air conditioners (S6).

As apparent from the above description, a central control system of air conditioners and a method for operating the same according to the present invention have the following features and advantages. The central control system is provided with a central control unit that includes a database for storing power consumption values of a plurality of air conditioners installed in a building. The central control unit executes an automatic operation algorithm that limits the total peak power consumption of air conditioners currently in operation below a reference power value. Maintenance, management and operating control of each air conditioner can be performed through the central control unit, thereby improving convenience of control. The present invention is also economical due to the possibility of management of powers of a plurality of air conditioners.

Although the central control system of air conditioners and the method for operating the same according to the present invention have been disclosed for illustrative purposes, those skilled in the art will appreciate that various modifications, additions and substitutions are possible, without departing from the scope and spirit of the invention as disclosed in the accompanying claims.

What is claimed is:

1. A central control system of air conditioners, comprising:

a plurality of air conditioners, installed in rooms of a building, for providing air conditioning; and a central control unit, connected to the plurality of air conditioners via a network, and configured for receiving a control command for monitoring and controlling each of the air conditioners, said central control unit adjusting an operating schedule of each of the air conditioners for limiting a total peak power consumption of the plurality of air conditioners in operation below a reference power value, said central control unit controlling an operation of each of the air conditioners based on the adjusted operating schedule, the central control unit comprising:

an air conditioner communication module for transmitting and receiving signals to and from the plurality of air conditioners via the network;

a database configured to store a maximum power consumption value for each of the air conditioners;

a peak operation processor configured to calculate a total peak power consumption based on the maximum power consumption value of each of the air conditioners stored in the database, and to determine an operating schedule and an operating mode of each of the air conditioners when the total peak power consumption of the air conditioners in operation exceeds the reference power value; and an air conditioner controller configured to issue a control signal for allowing a corresponding air conditioner to operate in the determined operating mode according to the determined operating schedule.

2. The system according to claim 1, the central control unit further comprising:

an input unit for inputting a control command for controlling the plurality of air conditioners; and a display unit for displaying state information of each of the air conditioners that are operated and controlled by the air conditioner controller.

3. The system according to claim 1, wherein an automatic operation algorithm is implemented in the peak operation processor, whereby when the total peak power consumption exceeds the reference power value, at least one air conditioner, selected from the plurality of air conditioners, is determined to operate in a normal operating mode, and at least one unselected air conditioner, other than the selected air conditioner, is determined to operate in a blowing mode.

4. The system according to claim 1, wherein the central control unit further includes an operating schedule update unit for updating the operating schedule of each of the air conditioners in a FIFO scheme in which an air conditioner that has entered a blowing mode first enters a normal operating mode first, and for transferring the updated operating schedule to the peak operation processor.

5. The system according to claim 4, wherein the operating schedule update unit updates the operating schedule of each of the air conditioners at intervals of a mode change period, said mode change period being input through the input unit.

6. The system according to claim 1, wherein the central control unit further includes an operating schedule update unit for updating the operating schedule of each of the air conditioners in such a manner that air conditioners enter a normal operating mode in descending order of the amount of change in temperatures of rooms where the air conditioners are installed, and for transferring the updated operating schedule to the peak operation processor.

7. The system according to claim 6, wherein the operating schedule update unit updates the operating schedule of each of the air conditioners at intervals of a mode change period, said mode change period being input through the input unit.

8. The system according to claim 1, wherein the air conditioners include one of a single-unit air conditioner including a single outdoor unit and a single indoor unit and a multi-unit air conditioner including a single outdoor unit and a plurality of indoor units sharing the single outdoor unit.

9. The system according to claim 1, wherein the air conditioners include one of a cooling only air conditioner in which refrigerant is circulated in one direction and an air conditioner for both cooling and heating in which refrigerant is circulated in two directions.

10. A method for operating a central control system of air conditioners, said central control system including a central control unit connected to a plurality of air conditioners via a network, said central control unit being configured to monitor states of the air conditioners and to control operations of the air conditioners, said method comprising the steps of:

comparing a total peak power consumption of a plurality of air conditioners currently in operation with a previously input reference power value;

allowing, when the result of the comparison indicates that the total peak power consumption exceeds the reference power value, at least one air conditioner selected from the plurality of air conditioners currently in operation to maintain a normal operating mode, and allowing at least one unselected air conditioner in operation, other than the selected air conditioner, to switch to a blowing mode;

updating an operating schedule of each of the air conditioners, when an operating time in the operating mode switched during the allowing exceeds a previously input mode change period; and controlling operations of the air conditioners according to the updated operating schedules.

11. The method according to claim 10, wherein the comparing includes the step of inputting the reference power value for comparison with the total peak power consumption of the plurality of air conditioners.

12. The method according to claim 10, wherein the comparing includes the step of inputting the mode change period at intervals of which the operating modes of the air conditioners are changed.

13. The method according to claim 10, wherein the updating includes the step of updating the operating schedule of each of the air conditioners in a FIFO scheme in which an air conditioner that has entered a blowing mode first enters a normal operating mode first.

14. The method according to claim 10, wherein the updating includes the step of updating the operating schedule of each of the air conditioners in such a manner that air conditioners enter a normal operating mode in descending order of the amount of change in temperatures of rooms where the air conditioners are installed.

15. A central control unit for a central control system of air conditioners that is connectable to a plurality of air conditioners installed in areas of a building via a network;

adjusting an operating schedule of each of the air conditioners for limiting a total peak power consumption of the plurality of air conditioners in operation below a reference power value and;

controlling an operation of each of the air conditioners based on the adjusted operating schedule, the central control unit comprising:

an air conditioner communication module configured to transmit and receive signals to and from the plurality of air conditioners via the network;

a database configured to store a maximum power consumption value of each of the air conditioners;

a peak operation processor configured to calculate a total peak power consumption based on the maximum power consumption value of each of the air conditioners stored in the database, and determining an operating schedule and an operating mode of each of the air conditioners when the total peak power consumption of the air conditioners in operation exceeds the reference power value; and an air conditioner controller configured to issue a control signal for allowing a corresponding air conditioner to operate in the determined operating mode according to the determined operating schedule.

16. The central control unit according to claim 15, wherein the central control unit further includes:

an input for inputting a control command for controlling the plurality of air conditioners; and a display for displaying state information of each of the air conditioners that are operated and controlled by the air conditioner controller.

17. The central control unit according to claim 15, wherein an automatic operation algorithm is implemented in the peak operation processor, and the algorithm selects, when the total peak power consumption exceeds the reference power value, at least one air conditioner, from the plurality of air conditioners, to be operated in a normal operating mode, and at least one air conditioner to be operated in a blowing mode.

18. The central control unit according to claim 15, further comprising an operating schedule update configured to update the operating schedule of each of the air conditioners in a FIFO scheme in which an air conditioner that has entered a blowing mode first enters a normal operating mode first, and to transmit the updated operating schedule to the peak operation processor.

19. The central control unit according to claim 15, further comprising an operating schedule updater configured to update the operating schedule of each of the air conditioners in such a manner that air conditioners enter a normal operating mode in descending order of the amount of change in temperatures of areas where the air conditioners are installed, and to transmit the updated operating schedule to the peak operation processor.

* * * * *